US007472730B2

(12) United States Patent
Adkins

(10) Patent No.: US 7,472,730 B2
(45) Date of Patent: Jan. 6, 2009

(54) WORK CENTER/CLAMPING TABLE AND STORAGE SYSTEM

(75) Inventor: Edward D. Adkins, Rockford, IL (US)

(73) Assignee: Nomis LLC, Hampshire, IL (US)

( * ) Notice: Subject to any disclaimer, the term of this patent is extended or adjusted under 35 U.S.C. 154(b) by 654 days.

(21) Appl. No.: 11/119,711

(22) Filed: May 2, 2005

(65) Prior Publication Data

US 2005/0241973 A1 Nov. 3, 2005

Related U.S. Application Data

(60) Provisional application No. 60/567,680, filed on May 3, 2004.

(51) Int. Cl.
*B25H 1/00* (2006.01)

(52) U.S. Cl. ..... 144/286.5; 144/287

(58) Field of Classification Search ..... 144/286.1, 144/286.5, 287, 285; 312/244, 245; 206/372, 206/373, 379

See application file for complete search history.

(56) References Cited

U.S. PATENT DOCUMENTS 837,224 A * 11/1906 Holcomb ..... 312/209
2,139,293 A * 12/1938 Wallgren ..... 144/285
4,105,055 A 8/1978 Brenta
5,174,349 A 12/1992 Svetlik et al.
5,513,574 A * 5/1996 Collins ..... 108/36
5,803,254 A 9/1998 Vasudeva
5,868,187 A 2/1999 Brand
6,044,973 A * 4/2000 Vasudeva ..... 206/372
6,113,202 A * 9/2000 Germano ..... 312/245
6,179,532 B1 * 1/2001 Oldham ..... 409/132
6,182,935 B1 2/2001 Talesky
6,484,767 B2 11/2002 Cameron
6,688,350 B2 2/2004 Heinlen et al.

OTHER PUBLICATIONS

The New Xshop™ Convertible Workshop, Internet site, last visited Apr. 28, 2005, 3 pages, Website: http://www.skilxshop.com.

* cited by examiner

*Primary Examiner*—Shelley Self
(74) *Attorney, Agent, or Firm*—Reinhart Boerner Va Deuren

(57) ABSTRACT

A method and apparatus are provided for transporting, operating, and storing power tools and their accessories, through the use of a portable work center apparatus including a closable case having a work surface fixedly attached thereto, and storage compartments therein. The work surface is enclosed within the case when the case is in a closed position, exposed when the case is in an open position, and adapted for supporting a work piece thereupon. The work surface is adapted for having a tool removably attached thereto. The work surface includes a vise and the apparatus includes hold down devices for securing a work piece on the work surface.

25 Claims, 11 Drawing Sheets

WORK CENTER/CLAMPING TABLE AND STORAGE SYSTEM

CROSS-REFERENCE TO RELATED PATENT APPLICATIONS

This patent application claims the benefit of U.S. Provisional Patent Application No. 60/567,680 filed May 3, 2004, the disclosure of which is incorporated herein in its entirety by reference.

FIELD OF THE INVENTION

This invention relates to power tools, and more particularly to the use and storage of small hand-held power tools of the type often used by hobbyists.

BACKGROUND OF THE INVENTION

Power hand tools, such as drills, rotary cutters, rotors and the like are widely used by tradesmen, hobbyists, and others in a variety of applications. In many of these applications, it is advantageous to have the power tool, and/or a work piece attached to a work surface in order to facilitate completion of the task at hand. It is also often advantageous, to have one or more power tools and associated bits, flexible shafts, clamping tools, marking tools, etc., stored in a case which may be conveniently transported to a job site, so that all tools and attachments are readily at hand while performing the task. It is further desirable that such a case be adapted for providing convenient storage of the tools and accessories when they are not in use.

For many jobs performed by such small power tools, it is highly advantageous, and sometimes necessary, for a work piece and/or the power tool to be supported upon or secured to a work surface. Although it has long been known, to store power tools and their related accessories in transportable cases, in the past, it has been necessary to remove the power tools and selected accessories from the case and set them up on a work surface, such as a work bench or table before performing the task at hand. Once the job is completed, the tools and accessories are removed from the work surface and placed back into the case for storage. U.S. Pat. No. 4,105,055 to Brenta illustrates one prior approach to storing power tool accessories within a case, with the accessories being assembled at the job site for use with power tools which are separately transported to the job site.

As a practical matter, however, it is often necessary or desirable to utilize power tools at locations where no work surface is readily available. In a small apartment, or home, for example it has sometimes been necessary in the past to utilize surfaces of dining room tables, kitchen counters, desks, etc. for supporting power tools and their accessories. This is often inconvenient, and undesirable in that the surface of such tables, desks, etc., may become marred during use of the power tool, and, in any event, clean-up of saw dust, metal shavings, etc., is typically required following use of the power tool, in order to return the surface to its normal use. The extra time and effort required to assemble a power tool and accessories, and remove them, as required by approaches, such as the one disclosed by Brenta in the U.S. Pat. No. 4,105,055 patent, add undesirable complexity and effort to the process of completing the task at hand. It is desirable, therefore, to provide a new and improved method and apparatus for transporting, operating and storing power tools and their accessories.

BRIEF SUMMARY OF THE INVENTION

The invention provides an improved method and apparatus for transporting, operating and storing power tools and their accessories, through the use of a portable work center apparatus including a closeable case having a work surface fixedly attached thereto, and storage compartments therein. The work surface is enclosed within the case when the case is in a closed position, exposed when the case is in an open position, and adapted for supporting a work piece thereupon. The case may include an upper and a lower portion thereof, adapted for joining to one another along a split line of the case, with the work surface being fixedly attached to a lower portion of the case and extending above the split line. The upper and lower portions of the case may be separable from one another, to thereby allow a work piece to extend beyond the work surface without contacting the upper portion of the case. The upper and lower portions of the case may be joinable to one another by a separable hinged connection.

The case may include one or more handles for carrying the work center. The case may include access through a sidewall thereof, to storage space within the case. A case, according to the invention, may include storage space below the work surface, accessible through the side wall of the case. A case, according to the invention, may further include access covers for closing off access to the storage space.

The work surface, of an apparatus, according to the invention, may be adapted for having a tool removably attached thereto. Where the tool includes a power head with a flexible shaft extending therefrom, the apparatus may include a tool hanger adapted for selective attachment to the remainder of the apparatus, for suspending the power head of the tool above the work surface. The tool hanger may be stowable within the case. The tool hanger may be attachable to the work surface.

A tool hanger, of an apparatus according to the invention, may include a support post, a pivot cap, and a hook, with the support post having a first and a second end thereof. The first end of the support post may be adapted for operative attachment to the work surface, such that the second end of the support post forms a distal end of the support post disposed above the work surface. The cap may be adapted for attachment to the distal end of the support post. The hook may be adapted for attachment to the cap and for supporting the power head of the tool, when the hook is attached to the cap. The work surface may include a tool hanger receptacle having locking lugs therein, and the tool hanger may further include a support post base having a lower end thereof including locking lugs for engagement with the locking logs and the power tool hanger receptacle. The support base may include a ferrule for receiving the support post base, and a locking collar for selectively locking the ferrule onto the support post base.

An apparatus, according to the invention may further include one or more retaining devices for holding a work piece in place with respect to the work surface. Such retaining devices may include, bench dogs, adapted for attachment to the work surface and having at least one surface thereof configured for bearing against an edge of the work piece.

The work surface may include one or more retaining devise attachment holes therein, for operatively receiving the retaining devices therein. The retaining devices may include a hold down clamp having a hold down post thereof adapted for insertion into one of the retaining devise holes. The hold down clamp may further include a flexible head portion thereof, attached to the hold down post. The head portion may have a clamping face thereof adapted for bearing against a work piece lying on the work surface, and a reaction face thereof adapted for bearing against the work surface in such a manner that the flexible head portion generates a clamping force against the work piece when the hold down clamp is pressed down passed an initial contact point of the clamping face and the reaction face with the work piece and work surface respectively.

The work surface, of an apparatus according to the invention, may be configured for applying a clamping force to the work piece. The work surface may include a stationary portion thereof, fixed against movement with respect to the case, and a movable portion thereof, operatively connected by a screw mechanism for linear movement of the movable portion with respect to both the stationary portion of the work surface and the case, in such a manner that a work piece may be clamped to the work surface through operation of the screw mechanism to urge relative motion between the movable and fixed portions of the work surface. The movable portion of the work surface may include a vacuum chamber thereof, having a vacuum port adapted for connection to a vacuum source, for convenient removal of saw dust, metal chips or other debris from the work surface. The screw apparatus may be disposed beneath the work surface and include an input that is operable by a vise handle extending through and accessible from outside of the case. The vise handle may be removable and stowable within the case.

An apparatus, according to the invention, may further include a removable, covered storage tray, disposed between the fixed and movable portions of the work surface, and having a removable cover thereof having an upper surface lying substantially flush with an upper surface of the work surface, when the covered storage tray is disposed between the fixed and movable portions of the work surface. An apparatus according to the invention may further include one or more retaining devices, attachable to the fixed and/or movable portions of the work surface for applying clamping force to the work piece, through operation of the screw mechanism, with one or more of the retaining devices being configured for storage within the covered storage tray.

The invention may also take the form of a portable work center apparatus including a closable case having a work surface physically attached thereto, and storage compartments therein providing space for stowage within the case of a power tool. Such an apparatus, according to the invention, may further include one or more retaining devices, stowable within the storage compartments of the case, for holding a work piece in place with respect to the work surface, and one or more mounting devices, stowable within the storage compartments of the case, for operatively connecting the power tool to the work surface. The case may include access through a side wall thereof to storage space within the case, for stowage of one or more of the power tool, and/or retaining devices, and/or mounting devices. The case may include storage space below the work surface, accessible through the side wall of the case.

In a work center apparatus, according to the invention, the work surface may be fixedly attached to the case by a support frame having two or more identical interlocking members.

The invention may also take the form of a method for constructing and/or operating a portable work center apparatus, according to the invention. The invention may also take the form of a kit, including one or more components according to the invention. The invention may also take the form of an individual component, according to the invention.

Other aspects, objectives and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
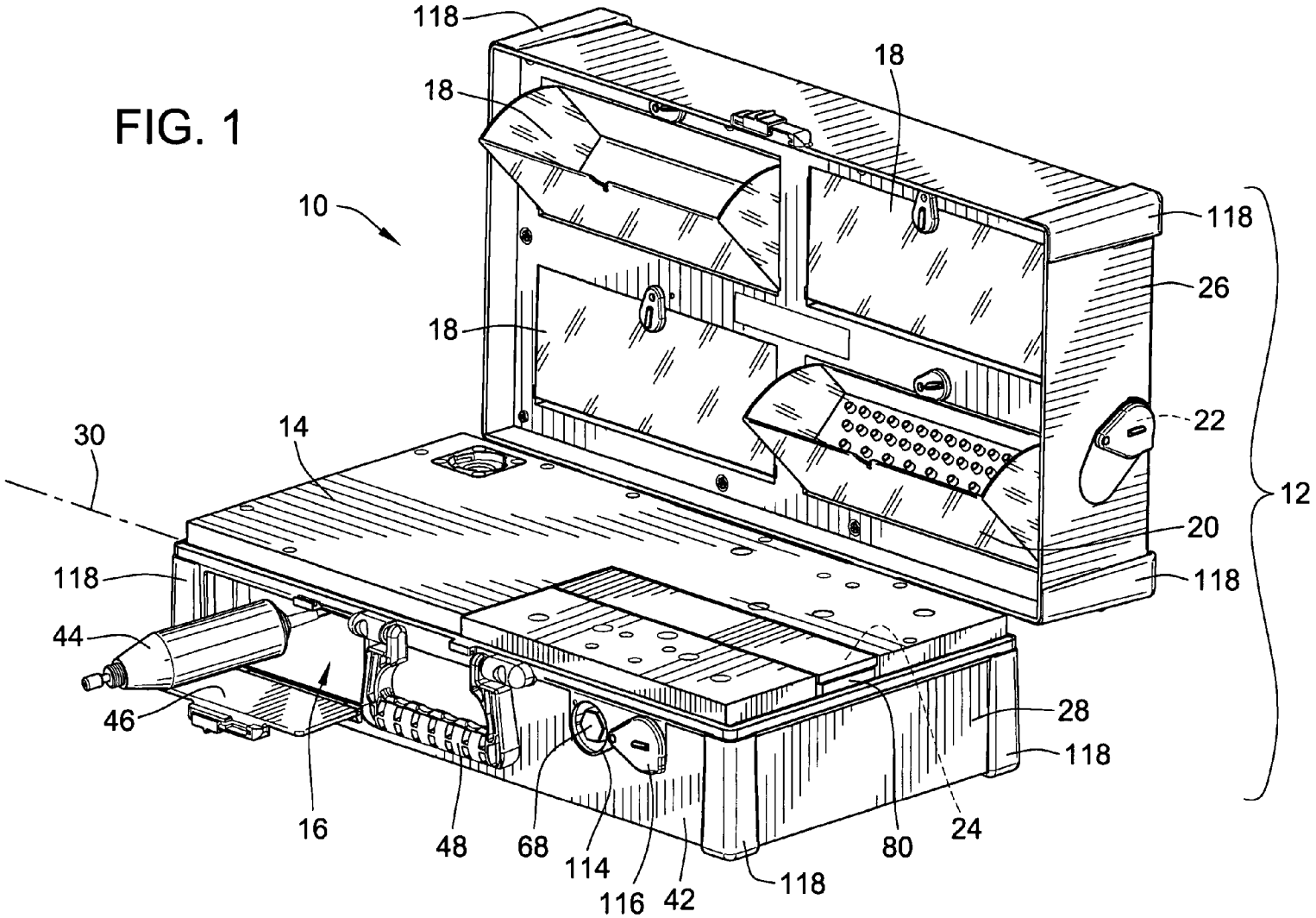
FIG. 1 is a perspective view of an exemplary embodiment of a portable work center, according to the invention.

FIG. 1 shows a first exemplary embodiment of a portable work center apparatus 10, according to the invention, including a closable case 12, having a work surface 14 fixedly attached thereto, and storage compartments 16, 18, 20, 22, 24 therein. The work surface 14 is adapted for supporting a work piece thereupon.

Figure 2:
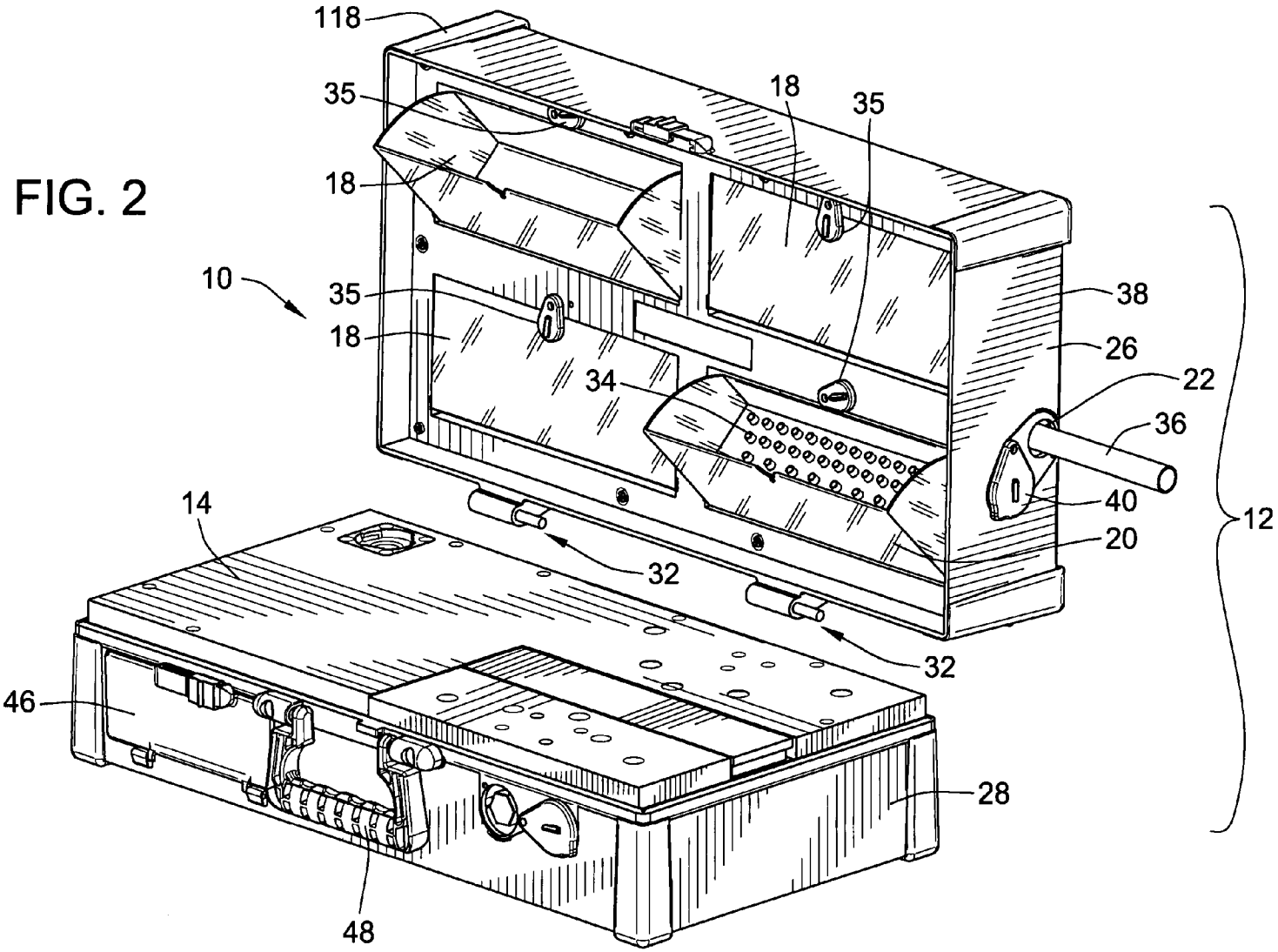
FIG. 2 is a perspective view of the portable work center of FIG. 1, showing the manner in which an upper and a lower portion of a case of the work center may be disconnected from one another to facilitate access to a work surface of the work center.

The case 12, of the exemplary embodiment, includes an upper and a lower portion 26, 28 thereof, adapted for joining to one another along a split line 30 of the case 12. As shown in FIG. 2, the upper and lower portions 26, 28 of the case 12 are joinable to one another by separable hinged connections 32, allowing the upper and lower portions 26, 28 of the case 12 to be separated from one another, so that a work piece may extend beyond the work surface 14 without contacting the upper portion 26 of the case 12. As shown in FIGS. 1 and 2, the upper portion 26 of the case 12 includes three tilt out bins 18 for receiving parts, accessories, etc., and a fourth tilt out bin 20 having a removable insert 34 therein for receipt and storage of bits, etc., for use with a power tool. The tilt out bins 18, 18, 18, 20, are held in a closed position by rotatable toggles 35. The storage compartment 22 is accessible through a side wall 38 of the upper portion 26 of the case 12, and configured for storage of any elongated support post 36, which is described in greater detail below. The storage compartment 22 is closable by means of a rotatable toggle 40 for retaining the support post 36 therein.

As shown in FIG. 1, the lower portion 28 of the case 12 includes a storage compartment 16, therein which is accessible through a side wall 42 of the lower portion 28 of the case 12 and configured, in the exemplary embodiment, for receipt and storage of a rotary tool 44 and accessories for the rotary tool 44 and/or the portable work center 10. The storage compartment 16, in the exemplary embodiment is closable by a hinged and latchable door 46 for retaining the tool 44 and accessories therein.

Figure 3:
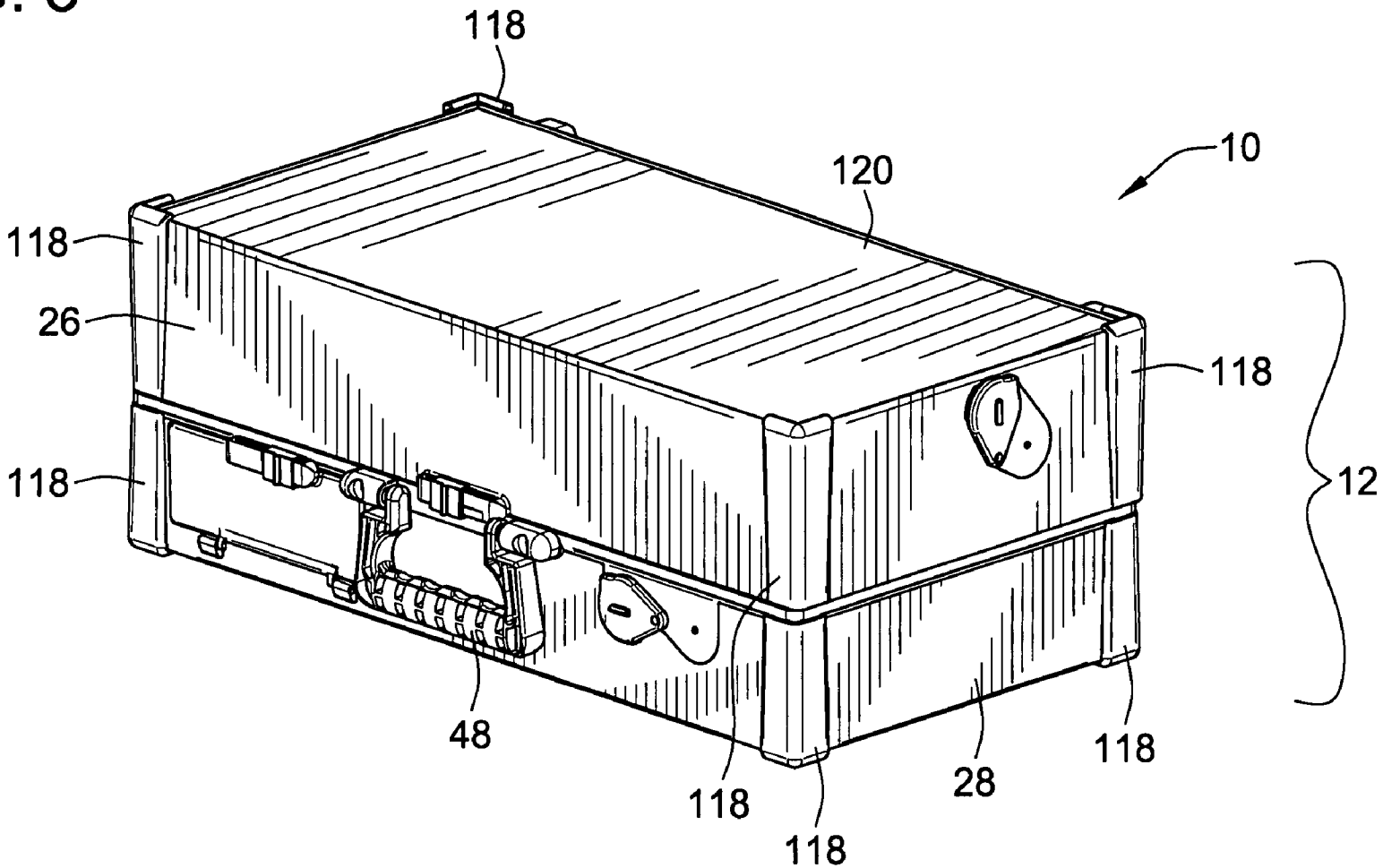
FIG. 3 is a perspective illustration of the work center of FIGS. 1 and 2, showing the case in a closed and latched, for transport and storage of the work center.

The work surface 14 is fixedly attached to the lower portion 28 of the case 12, in a manner described in greater detail below, which results in the work surface 14 extending above the split line 30. By virtue of the construction of the exemplary embodiment, it will be understood that the work surface 14 is enclosed within the case 12 when the case 12 is in a closed position as shown in FIG. 3, and exposed when the case 12 is in an open position, as shown in FIGS. 1 and 2, for example. The case 12, of the exemplary embodiment includes a handled 48, attached to the lower portion 28 of the case 12, for convenient transportation of the case 12.

Figure 4A:
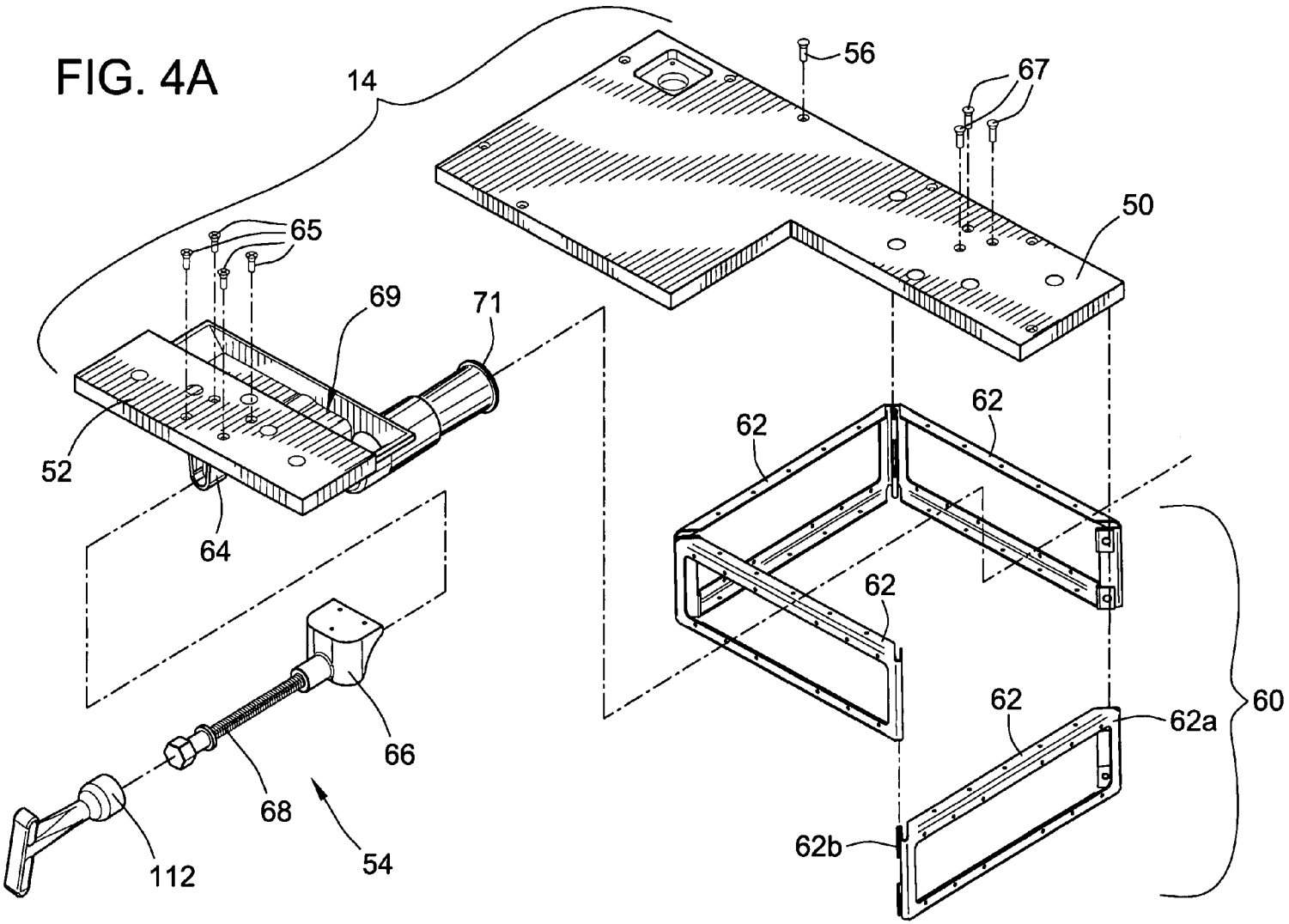
FIGS. 4A-4D illustrate construction details of a work surface of the work center of FIGS. 1-3, showing the manner in which the work surface of the exemplary embodiment provides a clamping vise, and a vacuum port for removal of debris during use of a power tool on the work surface.
Figure 4B:
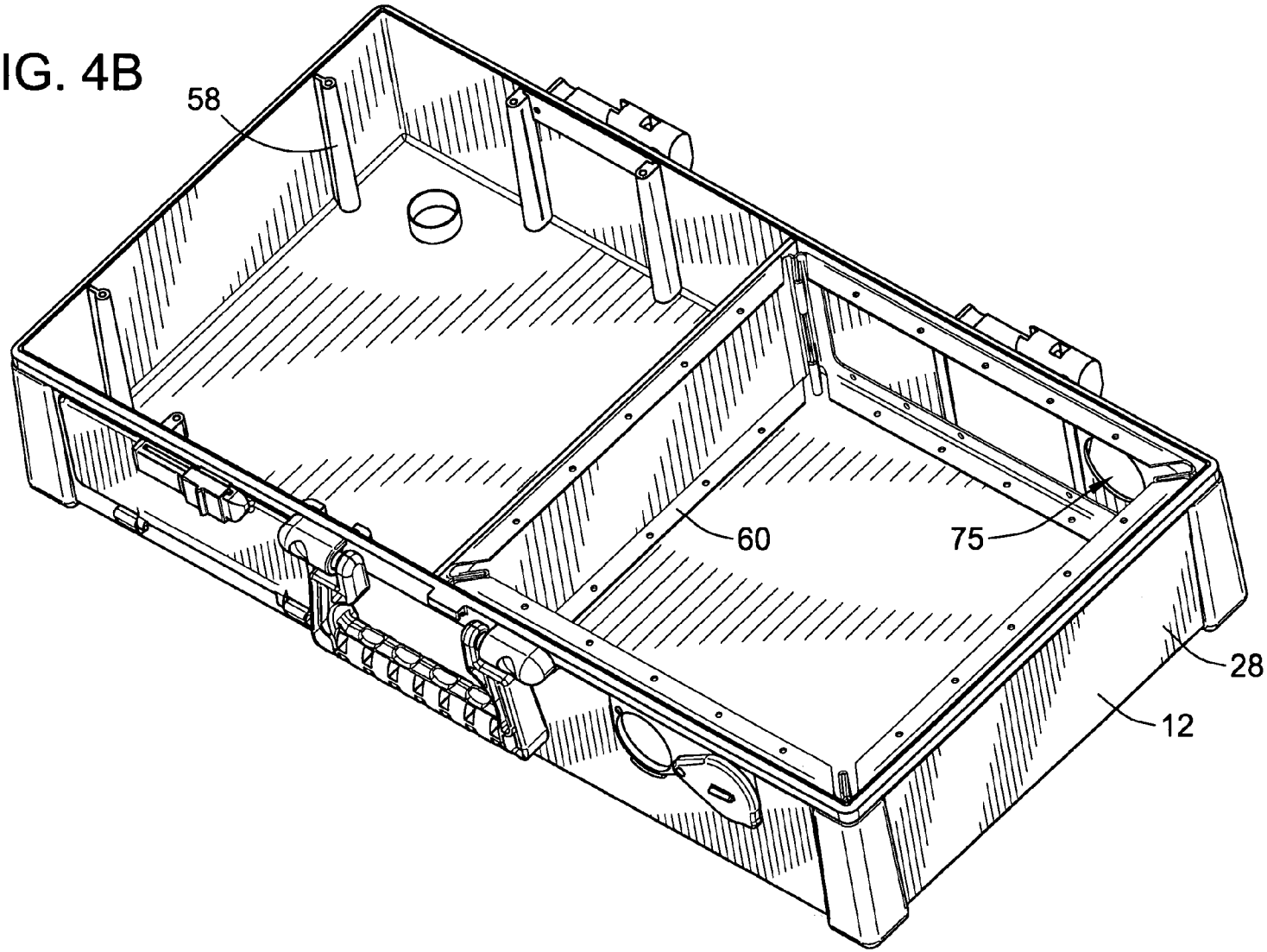
Figure 4C:
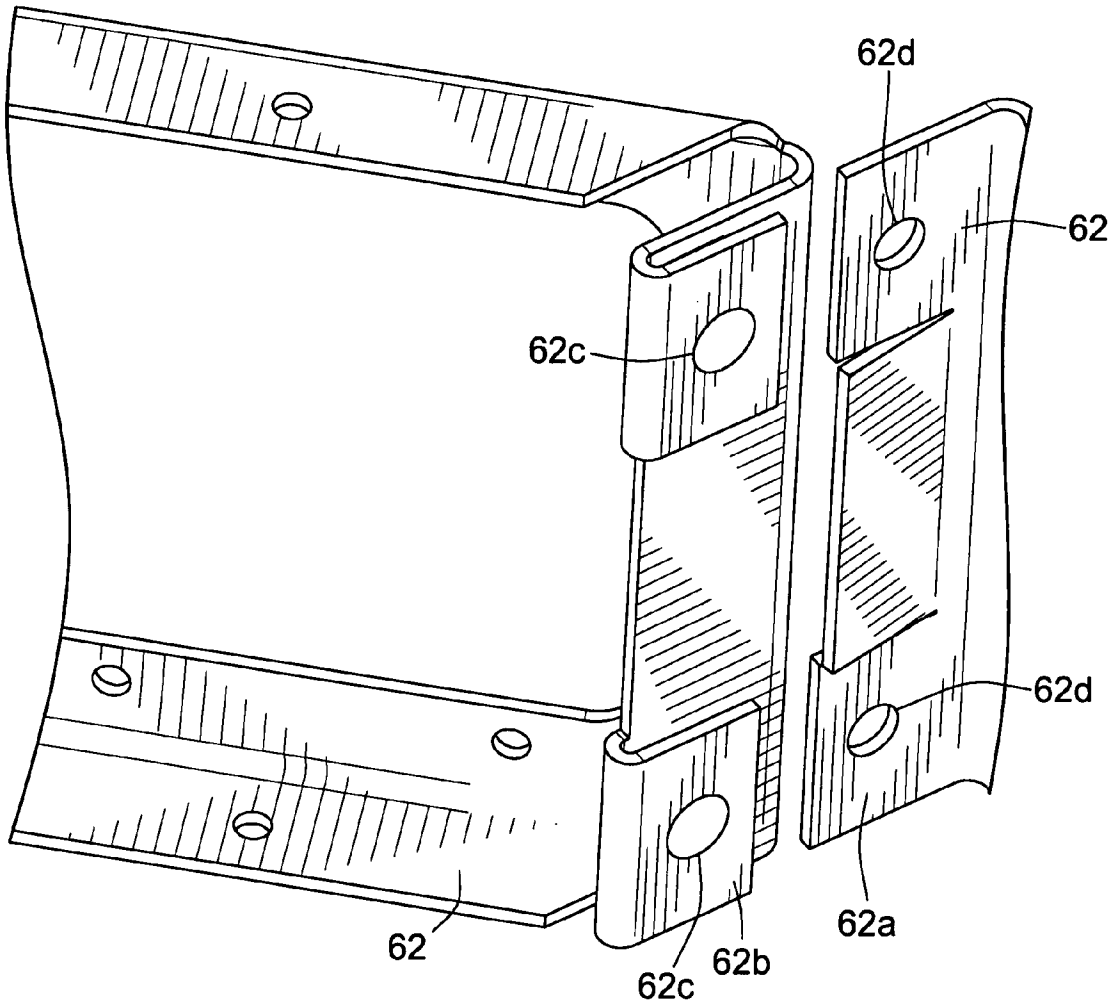

As shown in FIGS. 4A-4C, the work surface 14, of the exemplary embodiment, includes a stationary portion 50 thereof and a moveable portion 52 thereof connected by a screw mechanism 54. The stationary portion 50 of the work surface 14 is fixedly attached to the lower portion 28 of the case 12 by a plurality of screws 56, which engage corresponding bosses 58 in the lower portion 28 of the case 12 and a support frame 60 which is disposed between the work surface 14 and the lower portion 28 of the case 12. As best shown in FIGS. 4A and 4C, the support frame 60 of the exemplary embodiment, is formed from four identical frame panels 62. Alternate ends of the frame panel 62 are configured to form interlocking tabs 62*a* and channels 62*b*, best seen in FIG. 4C, which allow the adjoining frame panel 62 of the support frame 60 to be locked together without the use of additional fasteners or other joining means. Specifically, when locking tabs 62*a* on one end of the frame panel 62 are slidingly inserted into corresponding locking channels 62*b* on an adjoining frame panel 62, recessed detents 62*c* on the channel 62*b* lock into holes 62*d* on the tabs 62*a*.

Figure 4D:
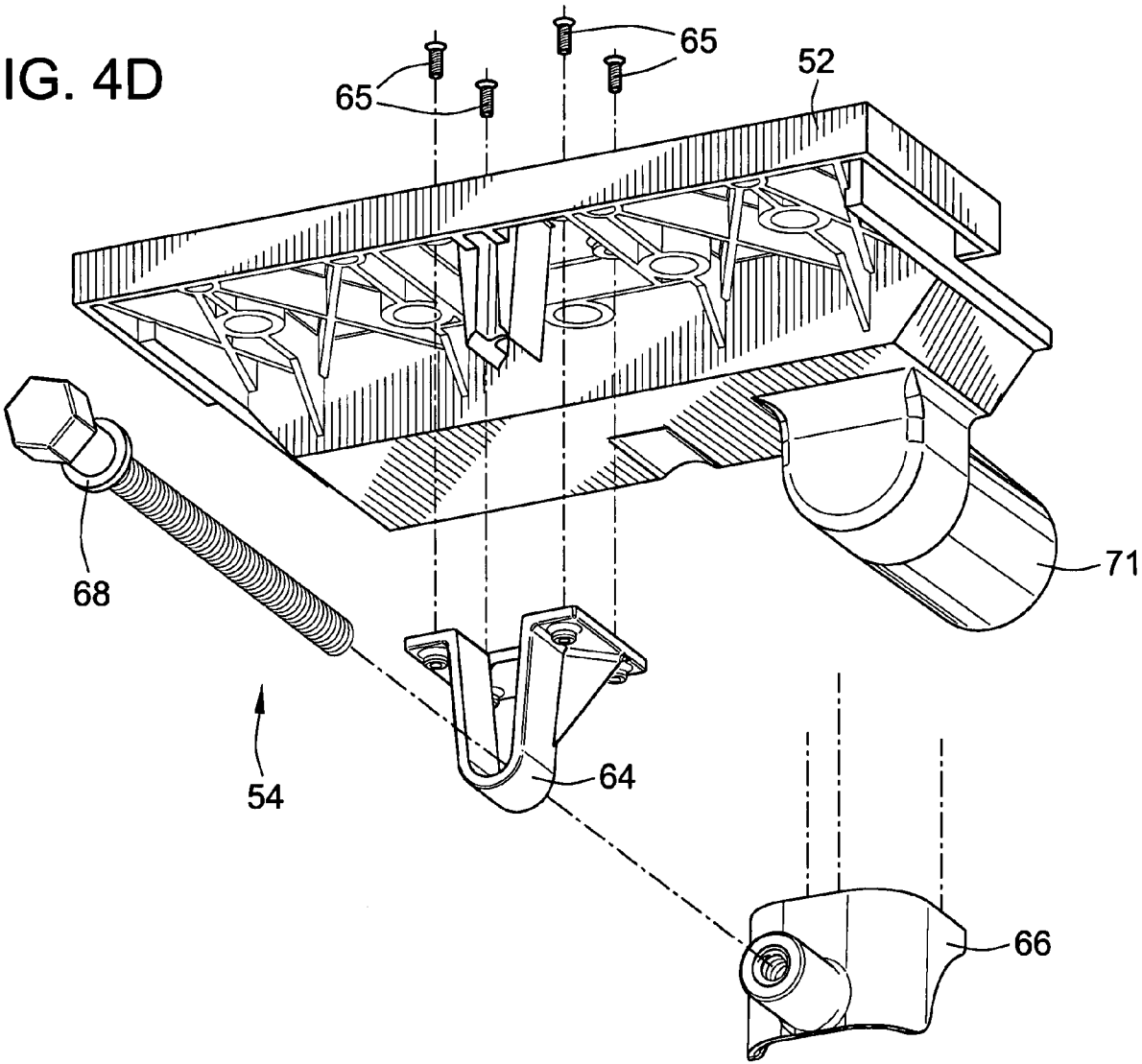

As shown in FIGS. 4A and 4D, the moveable portion 52 of the work surface 14 is operatively attached to the lower portion 28 of the case 12 by the screw mechanism 54, in such a manner that the moveable portion 52 of the work surface is capable of linear movement with respect to both the stationary portion 50 of the work surface 14 and the case 12 in such a manner that a work piece may be clamped to the work surface 14 through operation of the screw mechanism 54 to urge relative motion between the moveable and fixed portions 50, 52 of the work surface 14. Specifically, the moveable portion 52 of the work surface 14 is fixedly attached to a front bracket 64 of the screw mechanism 54 by four screws 65, as shown in FIG. 4D. A rear bracket 66 of the screw mechanism 54 is fixedly attached by three screws 67, in the manner illustrated in FIG. 4A, to the support frame 60 and the fixed portion 50 of the work surface 14. A screw 68 of the screw mechanism 54 extends rotatably through the front bracket 64 and threadably engages the rear bracket 66, in such a manner that as the screw 68 is rotated, the screw mechanism 54 causes the moveable portion 52 of the work surface 14 to advance toward or move away from the fixed surface 50 of the work surface 14. This relative motion between the moveable and stationary portions 50, 52 of the work surface 14 can be used for clamping a work piece to the work surface 14 in a manner described in greater detail below.

As shown in FIGS. 4A and 4D, the movable portion 52 of the work surface 14, of the exemplary embodiment, includes a vacuum chamber 69 thereof, having a vacuum port 71 adapted for connection to a vacuum source, such as a shop vac, for removing saw dust, metal filings, or other materials from the work surface 14 during use of a power tool. As shown in FIG. 4B, the lower portion 28 of the case 12 includes a hole 75 in a rear wall thereof, for access to the vacuum port 71.

The movable portion 52, of the work surface 14, of the exemplary embodiment, is further configured in such a manner that a lower surface of the movable portion 52 rests upon upper surfaces of the frame panel 62 of the support frame 60.

Figure 5:
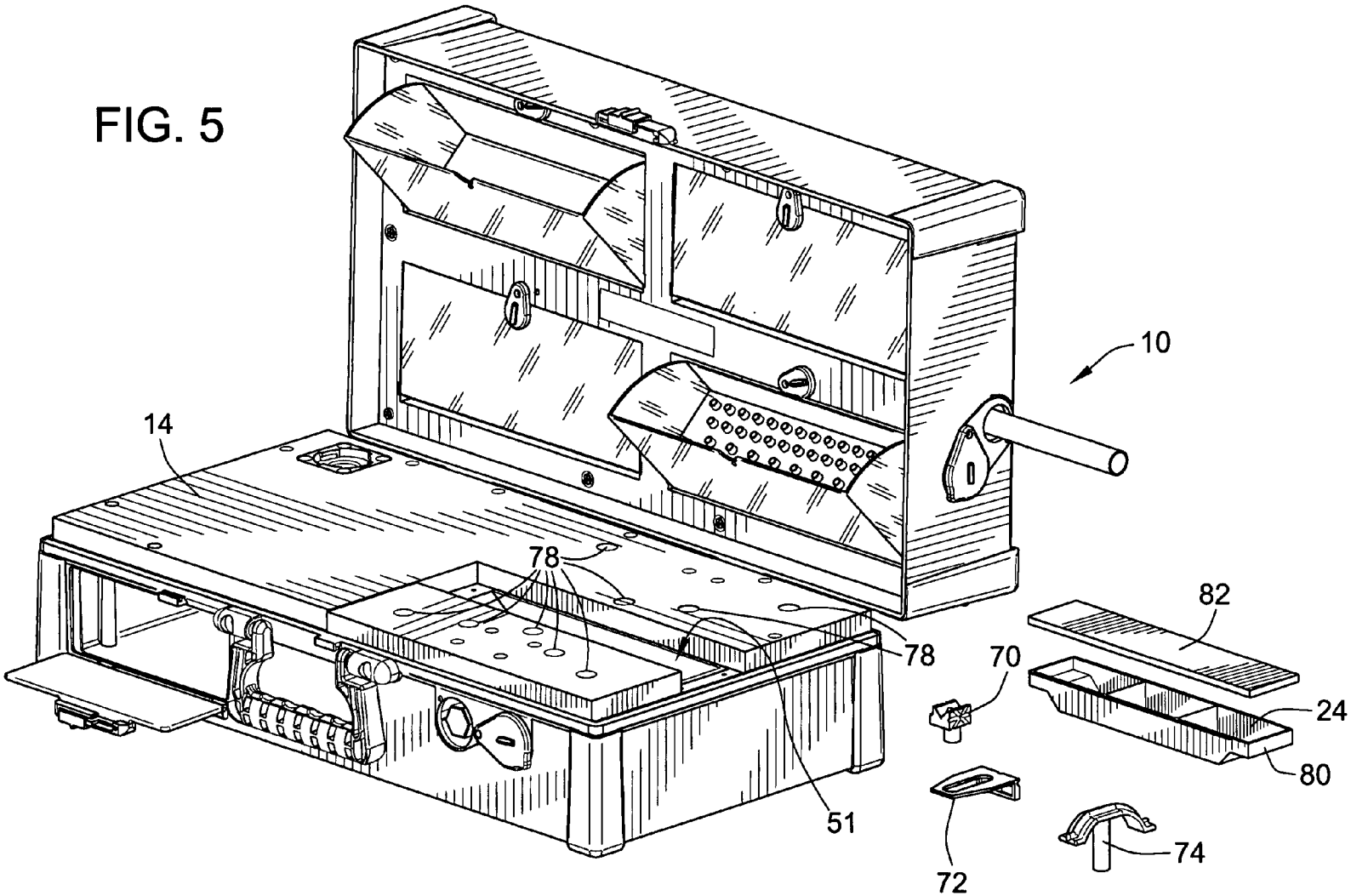
FIG. 5 is a perspective illustration of the exemplary embodiment of the portable work center apparatus of FIGS. 1-3, illustrating clamping devices and storage features of the exemplary embodiment of the work center.
Figure 6:
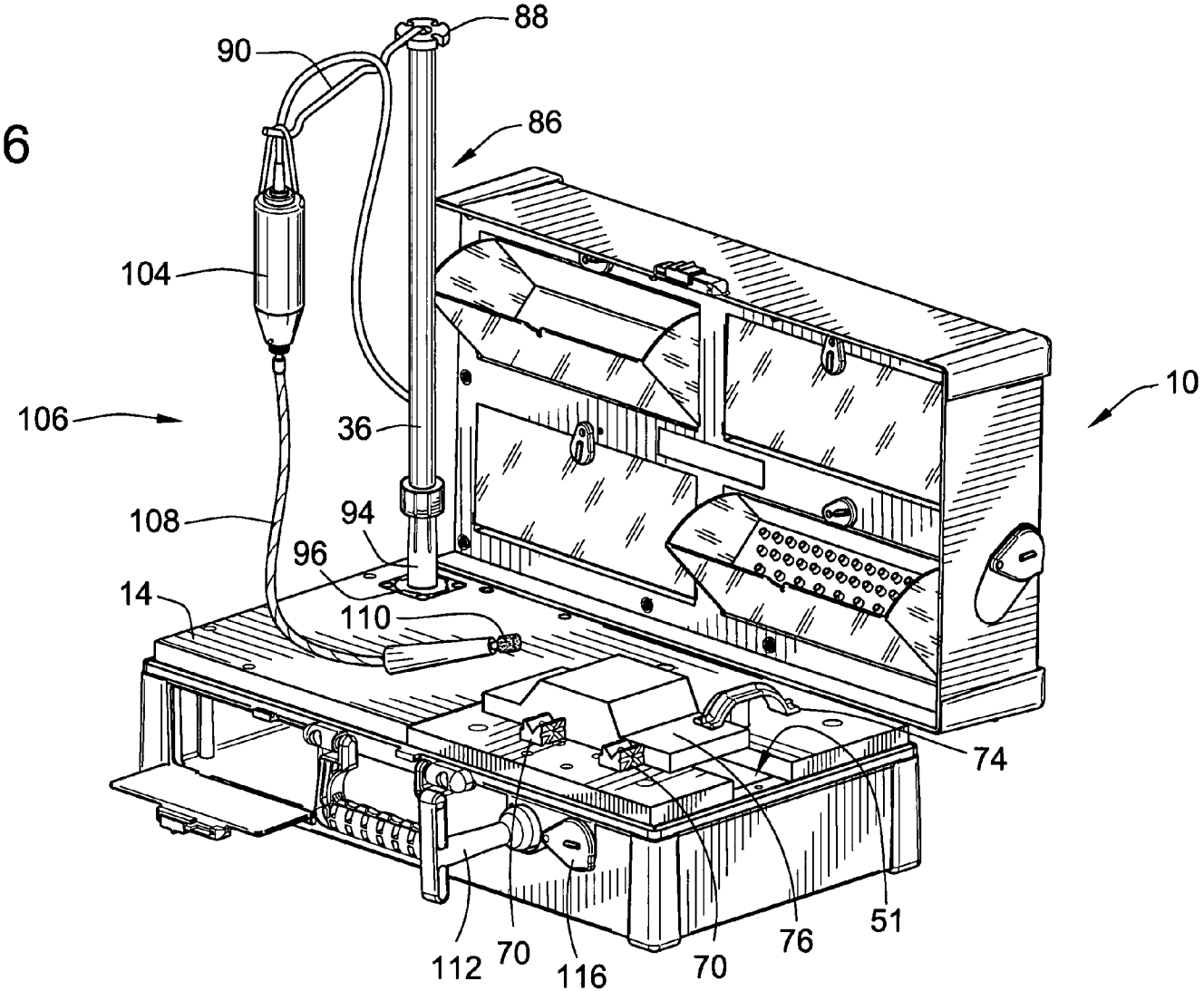
FIG. 6 is a perspective illustration of the work center of FIGS. 1-3, as configured for machining a work piece clamped onto the work surface with a tool bit driving by a flexible shaft attached to a tool power head suspending above the work surface, by a tool support hanger apparatus, according to the invention.

As shown in FIG. 5, the exemplary embodiment of the work center 10 also includes a plurality of hold down devices, such as bench dogs 70, soft jaws 72 and hold down clamps 74 for use in securing a work piece 76 onto the work surface 14 in a variety of manners, such as illustrated in FIG. 6. Specifically, in the exemplary embodiment, several bench dogs 70 and hold down clamps 74 are provided with each bench dog 70 and hold down clamp 74 including a hold down post portion thereof configured for insertion into one of a plurality of holes 78 extending through the work surface 14, as shown in FIG. 5. The soft jaws 72 include an elongated slot therein so that they can be anchored to the work surface 14 by insertion of the hold down post portion of one of the bench dogs 70 therethrough.

As shown in FIG. 5, the exemplary embodiment of the work center 10 includes a removable tray 80, having a sliding top 82 thereof which is configured for storage between the fixed and moving portions 50, 52 of the work surface 14, in the manner shown in FIG. 1. The tray 80 is configured for storage therein of the bench dogs 70 and soft jaws 72. The tray 80 and top 82 are further configured such that when the tray 80 is covered by the top 82 and stowed between the fixed and movable portions 50, 52 of the work surface 14 that the top of the cover 82 of the tray 80 lies substantially flush with the upper surface of the work surface 14, so that when the vise formed by the fixed and movable portions 50, 52 of the work surface 14 is not in use, the slot 51 between the fixed and moveable portions 50, 52 of the work surface 14 is filled in by the cover 82 of the tray 80.

Figure 7:
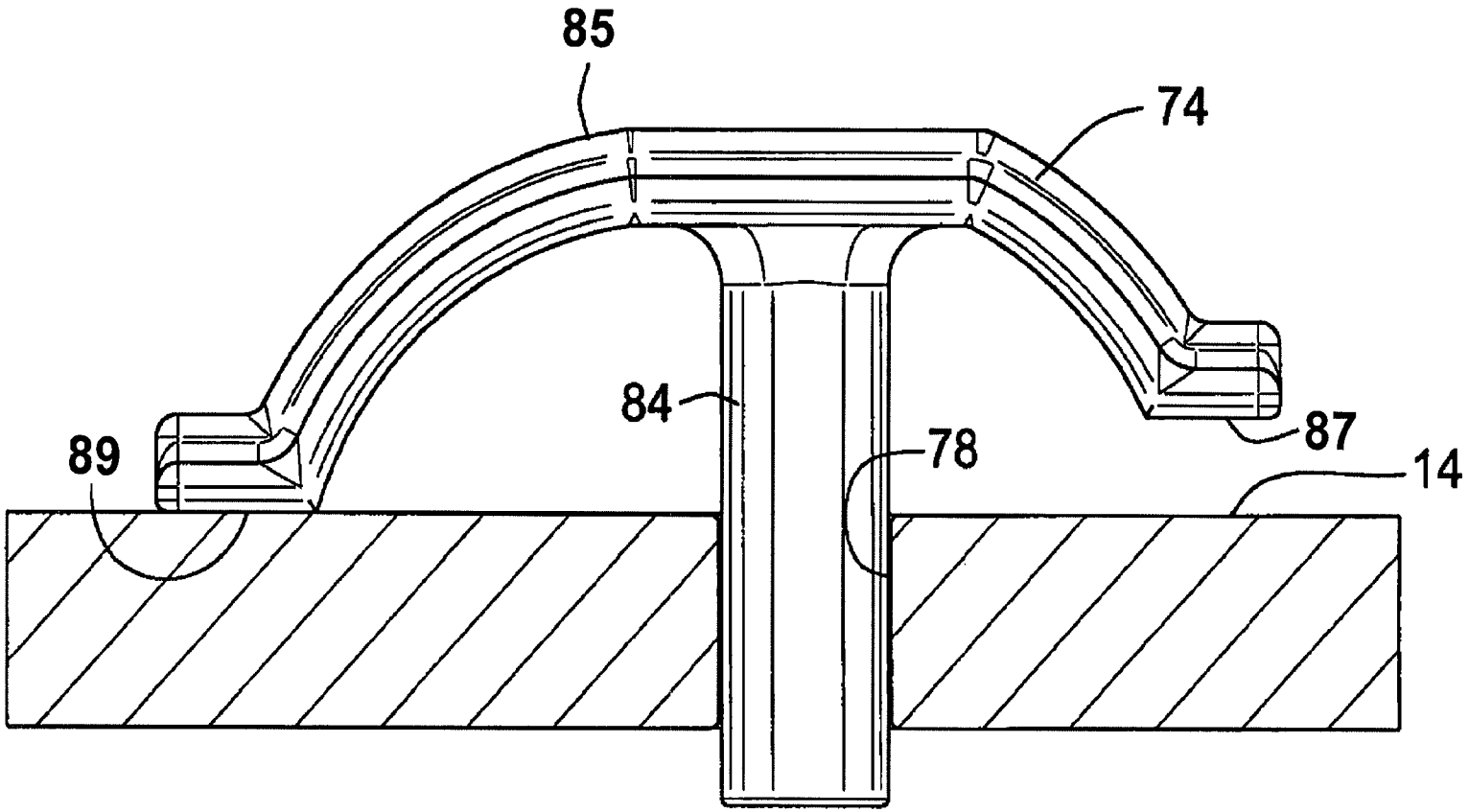
FIG. 7 is an orthographic illustration of a hold-down clamp, according to the invention.

As shown in FIG. 7, the hold down clamps 74, of the exemplary embodiment, include a hold down post 84 adapted for insertion into one of the holes 78 in the work surface 14. The hold down clamp 74 further includes a flexible head portion 85 thereof, having a clamping face 87 thereof adapted for bearing against a work piece lying on the work surface 14, and a reaction face 89 thereof adapted for bearing against the work surface 14, in such a manner that the flexible head portion 85 generates a clamping force against the work piece when the hold down clamp 74 is pressed down passed an initial contact point of the clamping face 87 and reaction face 89 with the work piece and work surface 14 respectively.

It will be understood, by those having skill in the art, that, in other embodiments of the invention, the work surface 14 may be adapted in many other ways for having a tool removably attached thereto. For example, a work center 10, according to the invention, may include provisions for attaching power tools to the top or bottom of the work surface 14, either directly, or through mounting arrangements other than the support posts disclosed herein, to provide a variety of functions such as shaping, sawing, drilling or plunge routing in the manner commonly performed with a drill press, in a wide variety of embodiments, within the scope of the invention.

The work surface 14 may, for example include holes or slots therethrough for passage of the tools or bits attached thereto. The work surface 14 may include recessed portions thereof for receiving mounting plates of tools and their attachments. Embodiments of the invention including a built-in vise, as provided in the exemplary embodiment described herein, may include tool mounting arrangements which may be adapted for being held in place through clamping force provided by relative movement of a fixed and a movable portion of the work surface 14. Such mounting structures or attachment components which may be utilized in alternative embodiments of the invention for operatively attaching a tool to the work surface 14 may be configured for stowage within the work center 10, in a manner similar to that described above in relation to the exemplary embodiment.

It will also be understood, that although the exemplary embodiment is illustrated in a form of a relatively small work center 10, which can be readily transported by a single handle 48 it is contemplated by the inventors that, in other embodiments of the invention, larger work centers may include several handles for facilitating transport, and may even include rollers or wheels along one or more edges of the work center 10 so that it can be conveniently moved in the same manner as one would utilize a modern piece of luggage having rollers or wheels to facilitate transportation of the piece of luggage, through an airport, for example.

It is further understood, that although the upper and lower 26, 28 portions of the case 12 are joined by separable hinged connections 32, in the exemplary embodiment of the invention described herein, in other embodiments of the invention it may be preferable to utilize other types of hinged, or non-hinged connections, including, for example releasable hasp connections for securing the upper and lower portions 26, 28 of the case 12 to one another for transport and/or storage of the work center 10.

Figure 8:
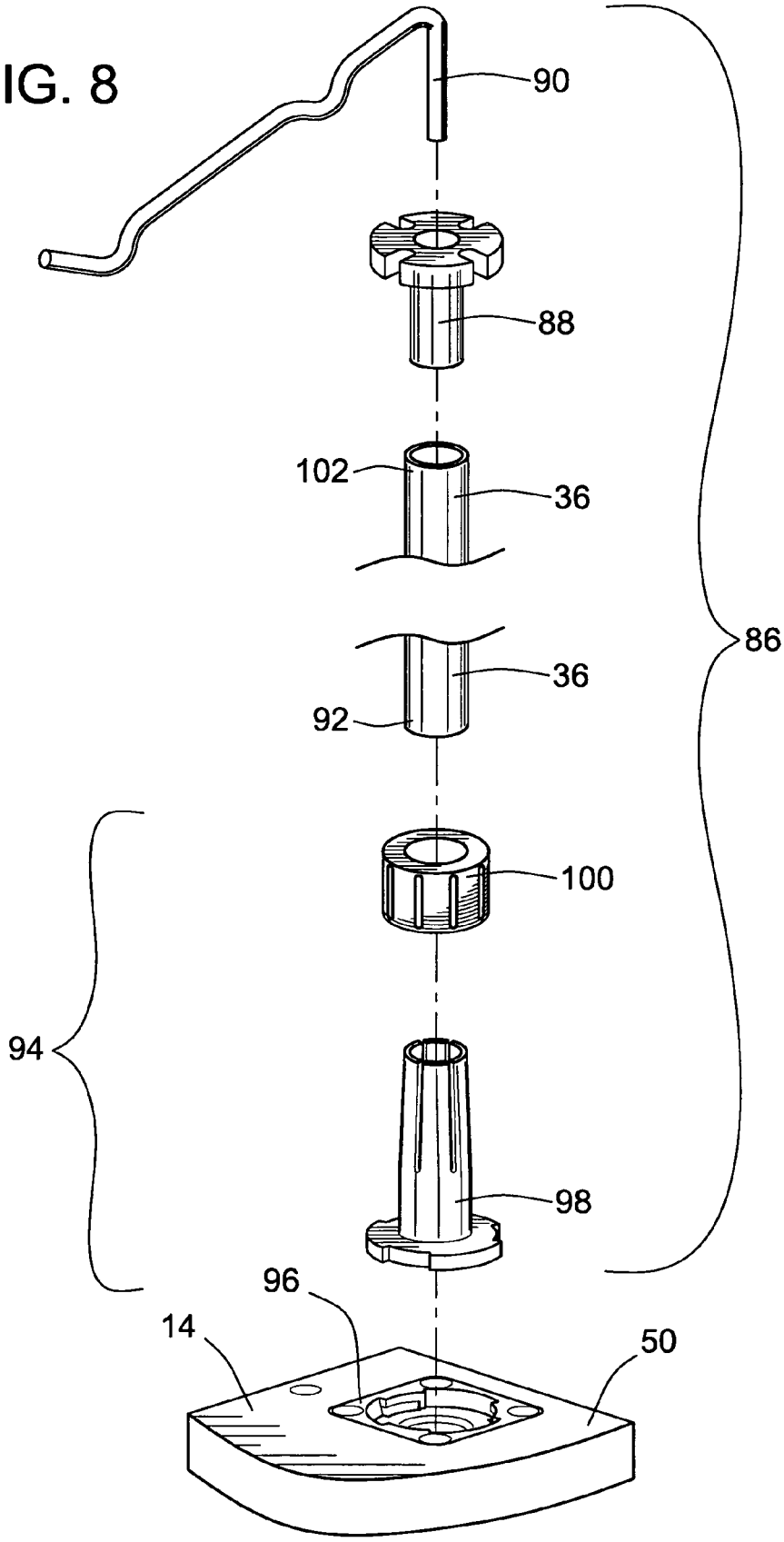
FIG. 8 is an exploded isometric view of the tool hanger apparatus shown in FIG. 6.

As shown in FIGS. 6 and 8, the exemplary embodiment of the work center 10 includes a tool hanger 86, which is attachable to the work surface 14 for removably and operatively attaching a tool to the work surface 14. Specifically, the tool hanger 86 includes the support post 36, a pivot cap 88, and a hook 90. A first end 92 of the support post 36 is adapted for operative attachment to the work surface 14 through a support post base 94 having a lower end thereof including locking lugs for engagement with corresponding locking lugs in a tool hanger receptacle 96 recessed into the fixed portion 50 of the work surface 14. One manner of forming such a locking engagement, is disclosed in a co-pending, commonly assigned U.S. patent application bearing the Ser. No. 10/777,016 the discloser of which is incorporated herein in its entirety.

As shown in FIG. 8, the support post base 94, of the exemplary embodiment, includes a ferrule 98 and a locking collar 100 for selectively locking the ferrule 98 onto the support post 36, when the lower end 92 of the support post 36 is inserted into the ferrule 98.

With the support post 36 inserted into the support post base 94, the upper end of the support post 36 forms a distal end 102 of the support post 36, disposed above the work surface 14. The pivot cap 88 is configured for insertion into the distal end 102 of the support post 36. The hook 90 is configured for insertion into the pivot cap 88, and is configured for supporting the power head 104 of a tool 106 having a flexible shaft 108 extending therefrom for driving a tool bit 110, as illustrated in FIG. 6.

As will be understood, from FIGS. 1 and 6, the work center 10, of the exemplary embodiment, includes a removable vise handle 112 configured for engaging the screw 68 of the screw mechanism 54 through an access hole 114 in the side wall 42 of the lower portion 28 of the case 12. The removable vise handle 112 is stowable within the case 12, in the tool storage compartment 16, or one of the tilt-out storage bins 18, 20. A rotatable cover 116 is provided for closing the access hole 114 for the vise handle 112, when the vise handle 112 is not attached to the screw 68 of the screw mechanism 54.

The work center 10 of the exemplary embodiment also includes other salient features, such as resilient, non-skid corner pieces 118 at all four corners of both the upper and lower portions 26, 28 of the case 12, for protecting corners of the case 12 against damage, and for providing secure placement of the top and bottom portions 26, 28 of the case 12 on a surface. As shown in FIG. 3, an outer surface of the upper portion 26 of the case 12 includes a dry-erase marker board 120, which can be used for making notes, calculations, or for other purposes related to use of the work center 10.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A portable work center apparatus, comprising:

a closable case having a work surface fixedly attached thereto, and storage compartments therein;

the work surface being configured for applying a clamping force to a workpiece and also being enclosed within the case when the case is in a closed position, exposed when the case is in an open position, and adapted for supporting a workpiece thereupon;

the work surface including a stationary portion thereof fixed against movement with respect to the case, and a movable portion thereof operatively connected by a screw mechanism for linear movement of the movable portion with respect to both the stationary portion of the work surface and the case in such a manner that a workpiece may be clamped to the work surface through operation of the screw mechanism to urge relative motion between the movable and fixed portions of the work surface.

2. The apparatus of claim 1, wherein the case includes an upper and a lower portion thereof, adapted for joining to one another along a split line of the case, with the work surface being fixedly attached to the lower portion of the case and extending above the split line.

3. The apparatus of claim 2, wherein the upper and lower portions of the case are separable from one another, to thereby allow a workpiece to extend beyond the work surface without contacting the upper portion of the case.

4. The apparatus of claim 3, wherein the upper and lower portions of the case are joinable to one another by a separable hinged connection.

5. The apparatus of claim 1, wherein the case includes one or more handles for carrying the work center.

6. The apparatus of claim 1, wherein the case includes access through a sidewall thereof to a storage space within the case.

7. The apparatus of claim 6, wherein the storage space is disposed below the work surface, and is accessible through the sidewall of the case.

8. The apparatus of claim 6, wherein the case further includes access covers for closing off access to the storage space.

9. The apparatus of claim 1, wherein the work surface is adapted for having a tool removably attached thereto.

10. The apparatus of claim 9, wherein:

the tool includes a power head with a flexible shaft extending therefrom; and the apparatus includes a tool hanger adapted for selective attachment to the apparatus for suspending the power head of the tool above the work surface.

11. The apparatus of claim 10, wherein the tool hanger is stowable within the case.

12. The apparatus of claim 10, wherein the tool hanger is attachable to the work surface.

13. A portable work center apparatus, comprising:

a closable case having a work surface fixedly attached thereto, storage compartments therein, and a tool hanger selectively attachable to the work surface;

the work surface being enclosed within the case when the case is in a closed position, exposed when the case is in an open position, and adapted for supporting a workpiece thereupon;

the work surface being adapted for having a tool removably attached thereto, wherein the tool includes a power head with a flexible shaft extending therefrom;

the tool hanger being adapted for suspending the power head of the tool above the work surface when the tool hanger is attached to the work surface; and the tool hanger including a support post, a pivot cap, and a hook, the support post having a first and a second end thereof, the first end being adapted for operative attachment to the work surface such that the second end forms a distal end of the support post disposed above the work surface, the cap being adapted for attachment to the distal end of the support post, the hook being adapted for attachment to the cap and for supporting the power head of the tool.

14. A portable work center apparatus, comprising:

a closable case having a work surface fixedly attached thereto, storage compartments therein, and a tool hanger selectively attachable to the work surface;

the work surface being enclosed within the case when the case is in a closed position, exposed when the case is in an open position, and adapted for supporting a workpiece thereupon;

the work surface being adapted for having a tool removably attached thereto, wherein the tool includes a power head with a flexible shaft extending therefrom;

the tool hanger being adapted for suspending the power head of the tool above the work surface when the tool hanger is attached to the work surface;

the work surface including a tool hanger receptacle having locking lugs therein, and the tool hanger further includes a support post base having a lower end thereof including locking lugs for engagement with the locking lugs in the tool hanger receptacle;

wherein the support post base including a ferrule portion thereof for receiving the support post base, and a locking collar for selectively locking the ferrule portion onto the support post base.

15. The apparatus of claim 1, further comprising one or more retaining devices for holding a workpiece in place with respect to the work surface.

16. The apparatus of claim 15, wherein the one or more retaining devices includes bench dogs, adapted for attachment to the work surface, and having at least one surface thereof configured for bearing against an edge of a workpiece.

17. A portable work center apparatus, comprising:

a closable case having a work surface fixedly attached thereto, storage compartments therein, and one or more retaining devices for holding a workpiece in place with respect to the work surface;

the work surface being enclosed within the case when the case is in a closed position, exposed when the case is in an open position, and adapted for supporting a workpiece thereupon; and the work surface including one or more retaining devise attachment holes therein for operatively receiving the retaining devices therein, and wherein the one or more retaining devices includes a hold down clamp having a hold down post thereof adapted for insertion into one of the retaining devise holes, the hold down clamp further having a flexible head portion thereof attached to the hold down post, the head portion having a clamping face thereof adapted for bearing against a workpiece lying on the work surface and a reaction face thereof adapted for bearing against the work surface in such a manner that the flexible head portion generates a clamping force against the work piece when the hold down clamp is pressed down past an initial contact point of the clamping face and the reaction face with the work piece and work surface respectively.

18. The apparatus of claim 13, where the work surface is configured for applying a clamping force to a workpiece.

19. The apparatus of claim 1, wherein the movable portion of the work surface includes a vacuum chamber thereof having a vacuum port adapted for connection to a vacuum source.

20. The apparatus of claim 1, wherein the screw apparatus is disposed beneath the work surface and includes an input that is operable by a vise handle extending through and accessible from outside of the case.

21. The apparatus of claim 20, wherein the vise handle is removable and stowable within the case.

22. The apparatus of claim 1, wherein the apparatus includes one or more retaining devices attachable to the fixed and/or movable portions of the work surface for applying clamping force to a workpiece through operation of the screw mechanism.

23. The apparatus of claim 1, wherein the apparatus further includes a removable covered storage tray disposed between the fixed and movable portions of the work surface, and having a removable cover thereof having an upper surface lying substantially flush with an upper surface of the work surface, when the covered storage tray is disposed between the fixed and movable portions of the work surface.

24. The apparatus of claim 23, wherein the apparatus includes one or more retaining devices attachable to the fixed and/or movable portions of the work surface for applying clamping force to a workpiece through operation of the screw mechanism, with one or more of the one or more retaining devices being configured for storage within the covered storage tray.

25. The apparatus of claim 23, wherein the movable portion of the work surface includes a vacuum chamber thereof having a vacuum port adapted for connection to a vacuum source, the vacuum chamber being exposed when the covered storage tray is not disposed between the fixed and movable portions of the work surface.

* * * * *